US007470076B1

(12) United States Patent
Dickover et al.

(10) Patent No.: US 7,470,076 B1
(45) **Date of Patent: *Dec. 30, 2008**

(54) PEN RETENTION APPARATUS

(75) Inventors: Wesley D. Dickover, Stuart, FL (US); Dean F. Herring, Youngsville, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/112,493

(22) Filed: Apr. 30, 2008

Related U.S. Application Data

(63) Continuation of application No. 11/939,724, filed on Nov. 14, 2007.

(51) Int. Cl.
*B43K 23/02* (2006.01)

(52) U.S. Cl. ..... 401/131; 401/48; 401/195; 401/88

(58) Field of Classification Search ..... 401/131, 401/88, 48, 6, 195
See application file for complete search history.

(56) References Cited

U.S. PATENT DOCUMENTS 1,506,207 A * 8/1924 Wahl ..... 401/131
1,511,167 A 10/1924 Jesnig
5,123,548 A * 6/1992 Milne ..... 401/88
5,379,928 A * 1/1995 Mikkelsen ..... 224/257
5,815,873 A * 10/1998 Jones ..... 15/106
5,947,623 A * 9/1999 Smith ..... 401/131
6,318,921 B1 * 11/2001 Craine ..... 401/131
6,394,677 B2 * 5/2002 Wang ..... 401/6
2007/0237566 A1 10/2007 Silverstein et al.

FOREIGN PATENT DOCUMENTS

GB 2288150 A 10/1995
GB 2410469 A 8/2005

* cited by examiner

*Primary Examiner*—Khoa D Huynh
(74) *Attorney, Agent, or Firm*—Cantor Colburn LLP; Jason O. Piche

(57) ABSTRACT

A pen retention device for releasably securing a pen to a tether is disclosed. The device includes a pen having an end, a collar defining an internal cavity surrounding the end and an orifice having a diameter, an elastic retainer disposed within the internal cavity, and an anvil securedly attached to the tether. An outer surface of the elastic retainer defines an internal dimension and an external dimension of the elastic retainer, the external dimension greater than the diameter of the orifice such that the internal cavity retains the elastic retainer. The anvil includes an angled retention surface having an external diameter greater than the internal dimension of the elastic retainer and less than the diameter of the orifice.

4 Claims, 3 Drawing Sheets

PEN RETENTION APPARATUS

CROSS REFERENCE TO RELATED APPLICATION

This application is a Continuation application of U.S. Ser. No. 11/939,724, filed Nov. 14, 2007, the contents of which are incorporated by reference herein in their entirety.

BACKGROUND OF THE INVENTION

1. Field of the Invention

This invention relates generally to pen retention devices, and particularly to of point of sale signature pen retention devices.

2. Description of Background

Point of sale devices may provide pens, such as electronic signature pens for example, for a shopper to authorize a sale transaction. It is important to retain and secure the pen in a location that is convenient for use and such that it cannot easily be taken by the shopper. Typical pen retention arrangements include a tether attached to the pen and a retracting reel, such that the tether is drawn into the retracting reel when the pen is not in use. The pen is intended to be disposed within an accompanying recess such that the pen does not obstruct a flow of purchased products. To discourage any pilferage of the pen, tether, and retracting reel, the retracting reel is often disposed beneath a surface of the point of sale device, such that it is inaccessible to the shopper.

Failure by the shopper to ensure proper return of the pen to the accompanying recess may result in the pen becoming entangled with the flow of purchased products, application of excessive tether force, and failure of either the tether or the retracting reel. Repair of such tether or retracting reel failure requires a service technician to disassemble the point of sale device and replace the retracting reel, tether, and pen. Accordingly, there is a need in the art for a pen retention arrangement that overcomes these drawbacks.

SUMMARY OF THE INVENTION

An embodiment of the invention includes a pen retention device for releasably securing a pen to a tether. The device includes a pen having an end, a collar securedly attached to the pen proximate the end, defining an internal cavity surrounding the end and an orifice having a diameter, an elastic retainer disposed within the internal cavity, and an anvil securedly attached to the tether. An outer surface of the elastic retainer defines an internal dimension and an external dimension, the external dimension greater than the diameter of the orifice such that the internal cavity retains the elastic retainer. The anvil includes an angled retention surface having an external diameter greater than the internal dimension of the elastic retainer and less than the diameter of the orifice. The internal dimension of the elastic retainer retains the external diameter of the anvil disposed between the pen and the elastic retainer and the internal dimension of the elastic retainer is responsive to an application of force greater than a release force, via the angled retention surface, to deform and thereby release the anvil.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

An embodiment of the invention provides a pen retention device to releasably secure the pen to the tether. The pen retention device releases the pen from the tether before application of a force likely to damage either of the tether or the retracting reel. The pen retention device further allows replacement of the pen subsequent to such release without need for a service technician to disassemble the point of sale device.

Figure 1:
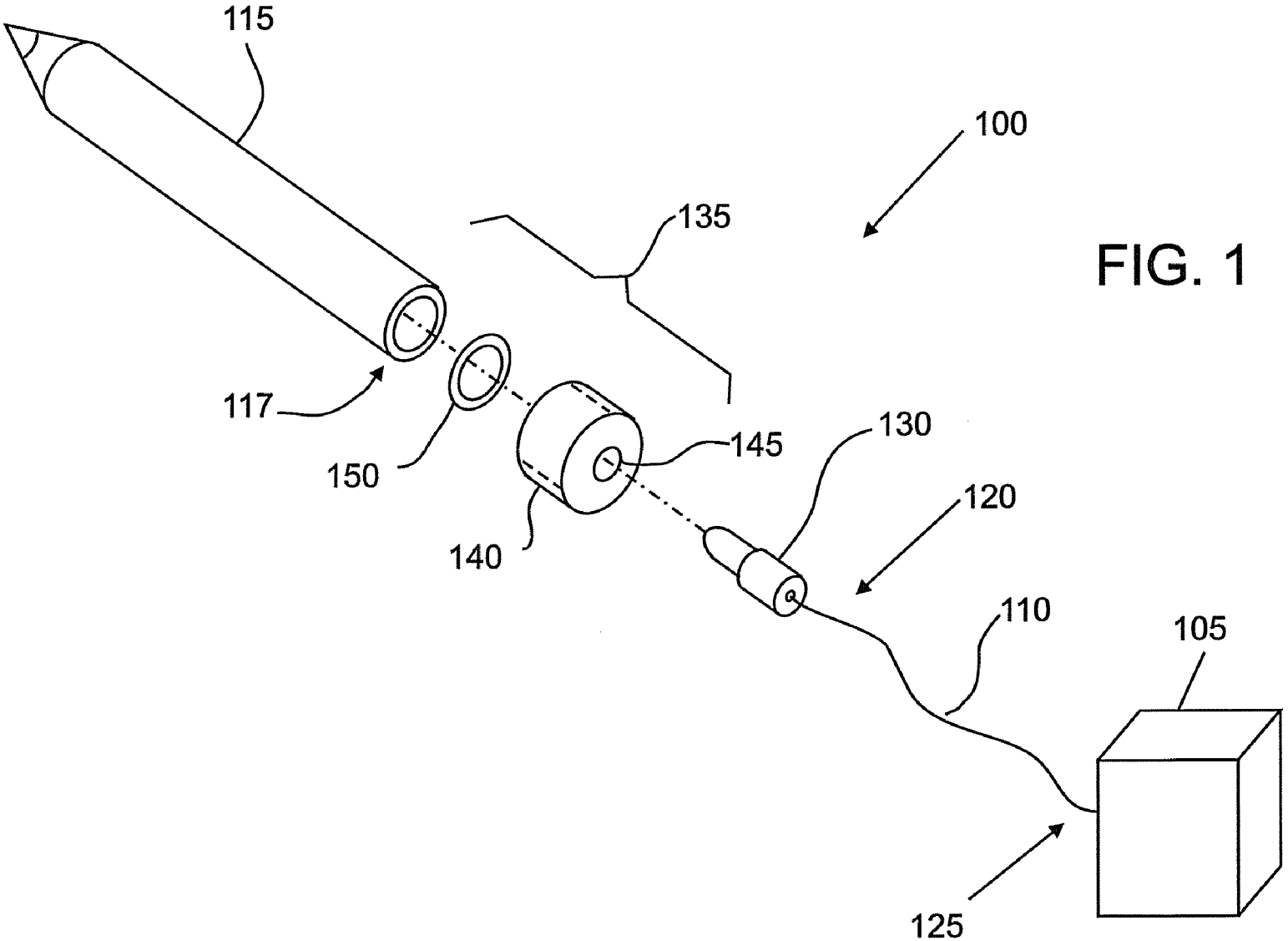
FIG. 1 is a front perspective exploded assembly view of a pen retention device in accordance with an embodiment of the invention.

FIG. 1 depicts an embodiment of a pen retention device 100. The pen retention device 100 includes a retracting reel 105 (also herein referred to as a "tether retracting reel"), a tether 110, such as a string or wire for example, and a pen 115 releasably attached to the tether 110. The tether 110 includes a first end 120 releasably attached proximate an end 117 of the pen 115 and a second end 125 in operable communication with the retracting reel 105. The tether 110 is withdrawn from the retracting reel 105 to allow the shopper to utilize the pen 115 to authorize a sales transaction. The retracting reel 105 includes a retraction mechanism such as a spring (not shown) to retract or return the tether 110 within the retracting reel 105 when the pen 115 in not in use. The pen retention device 100 further includes an anvil 130 securedly attached to the first end 120 of the tether 110. An anvil retention assembly 135 includes a collar or cap 140 having an aperture or orifice 145 and an elastic retainer 150. In one embodiment, the elastic retainer 150 is a rubber 0-ring 150.

Figure 2:
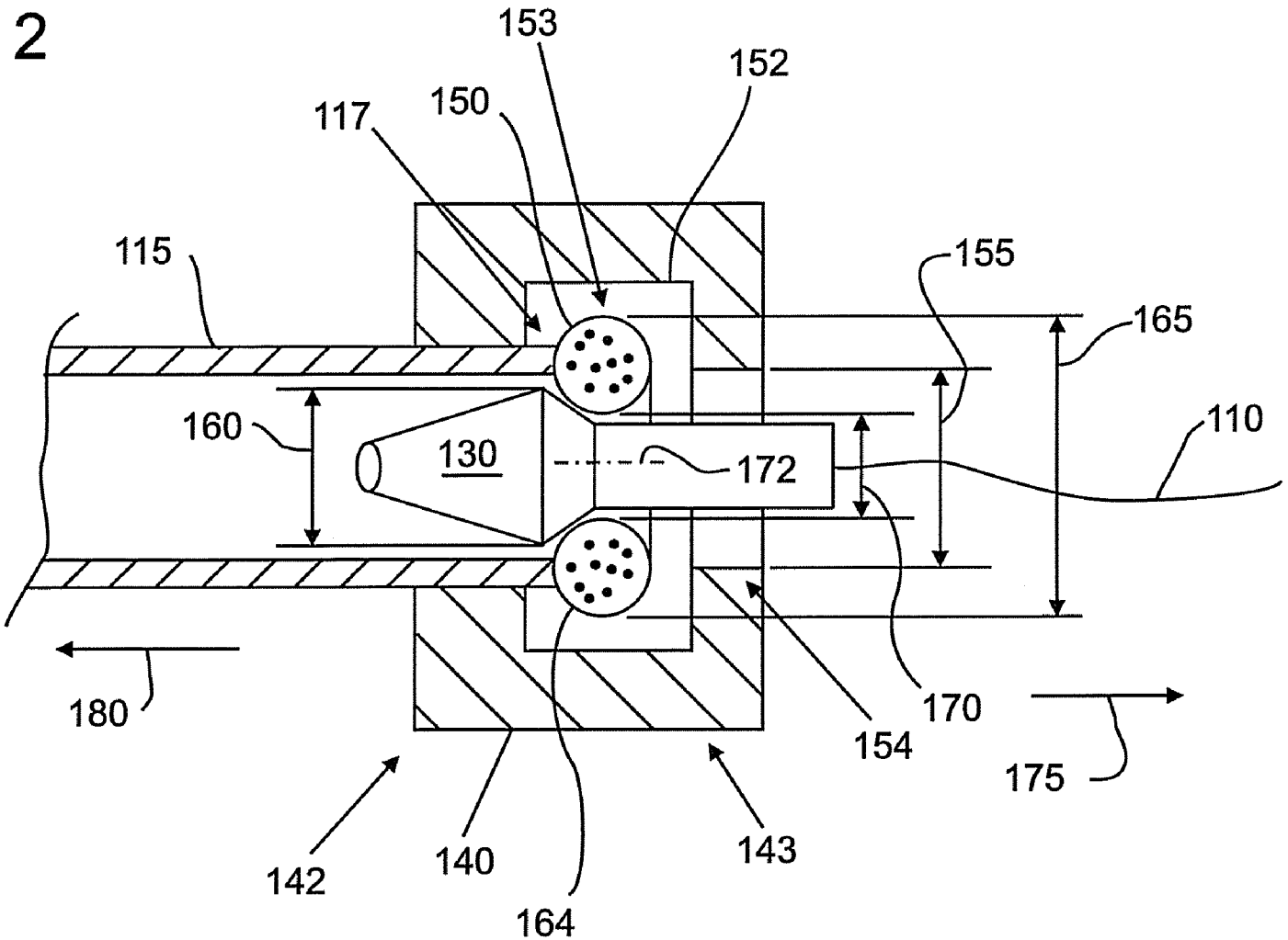
FIG. 2 is an enlarged cross section view of the pen retention device of FIG. 1 in accordance with an embodiment of the invention.

FIG. 2 is an enlarged cross section depicting the relation of the anvil 130, anvil retention assembly 135, elastic retainer 150, and pen 115. The collar 140 includes a first portion 142 and a second portion 143. The first portion 142 of the collar 140 is securedly attached to the pen 115 proximate the end 117, by any appropriate attachment means, such as via threads, an adhesive, or an interference fit for example, and retains the elastic retainer 150 disposed between the pen 115 and collar 140. The second portion 143 of the collar 140 includes a surface 152 of the collar 140 that defines an internal cavity 153 and another surface 154 that defines the orifice 145. The elastic retainer 150 is disposed within the internal cavity 153. A diameter 155 of the orifice 145 is greater than a maximum external diameter 160 of the anvil 130, such that the anvil 130 may be freely inserted and withdrawn through the orifice 145 of the collar 140.

An outer surface 164 of the elastic retainer 150 defines an external dimension 165, such as an outer diameter, and an internal dimension 170 such as an internal diameter. The external dimension 165 is disposed at a greater radial distance from a center 172 of the elastic retainer 150 than the internal dimension 170. The diameter 155 of the orifice 145 is smaller than the outer diameter 165 of the O-ring 150. Therefore, the O-ring 150 cannot be withdrawn through the orifice 145, and is retained within the internal cavity 153 by the collar 140.

The inner diameter 170 of the O-ring 150, in an undeformed state, is smaller than the diameter 160 of the anvil 130. Therefore the anvil 130 cannot be drawn through the undeformed inner diameter 170 of the O-ring 150. As such, the undeformed inner diameter 170 of the O-ring 150 retains the outer diameter 160 of the anvil 130 within the pen 115, disposed between the end 117 of the pen 115 and the O-ring 150.

For example, a force applied to the anvil 130, such as via the tether 110 in a first direction 175, and to the collar 140, such as via the pen 115, in a second direction 180 shall displace the O-Ring 150 to a right most position (in the direction 175) within the cavity 153. Because the outer diameter 165 of the O-ring 150 is greater than the diameter 155 of the orifice 145, the orifice 145 retains the O-ring 150 and anvil 130.

Figure 3:
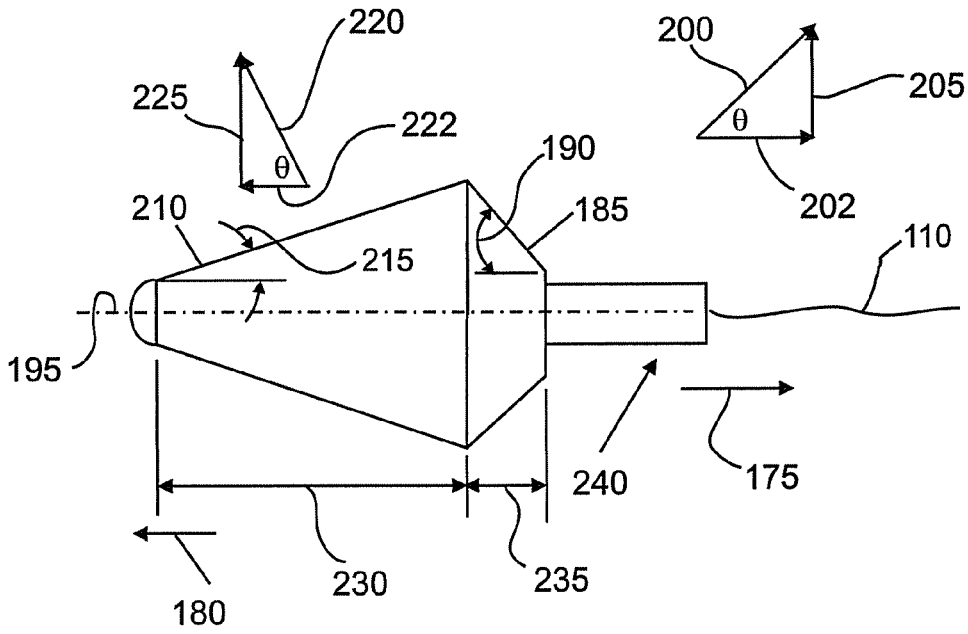
FIG. 3 is an enlarged end view of an anvil of the pen retention device in accordance with an embodiment of the invention.

Referring now to FIG. 2 in conjunction with FIG. 3, further details related to interaction between the O-ring 150 and anvil 130 will be described. A retention surface 185 (also herein referred to as an "angled retention surface") of the anvil 130 is disposed at an angle 190 included between the retention surface 185 and an axial centerline 195 of the anvil 130. As described above, the maximum external diameter 160 of the retention surface 185 is greater than the inner diameter 170 of the O-ring 150. Application of force to the anvil 130 in the first direction 175 produces a reaction force 200 that is directed perpendicular to the retention surface 185. The reaction force 200 thereby includes a first force component 202 aligned with the centerline 195 and a second force component 205 perpendicular to the centerline 195, transferred from the retention surface 185 of the anvil 130 to the O-ring 150. The second force component 205 tends to deform or expand at least the inner diameter 170 of the O-Ring 150. It will be appreciated that deformation of the inner diameter 170 of the O-Ring 150 may include deformation of the outer diameter 165.

Accordingly, the O-ring 150 deforms in response to application of force via the anvil 130 in the first direction 175. As such, the O-ring 150 provides a "break-away" feature that releases the anvil 130 via the orifice 145 in response to application of an amount of force that exceeds a release force. Properties of the material from which the O-ring 150 is fabricated as well as a thickness of the material influence an amount of deformation in response to a given amount of applied force. Accordingly, selection of the material properties and geometry of the O-ring 150 influence the release force that deforms the inner diameter 170 sufficiently and allows the anvil 130 to be withdrawn from the pen 115 via the O-ring 150 and orifice 145. Stated alternatively, the inner diameter 170 of the O-ring 150 is responsive to an application of force to the anvil 130 greater than the release force to elastically deform and thereby release the anvil 130 via the orifice 145.

In one embodiment, the material properties and geometry of the O-ring 150 are selected to correspond to the release force that releases the anvil 130 from the pen 115 prior to damage to (or failure of) either the tether 110 or the retracting reel 105. Therefore, following such release of the anvil 130, useful functionality of the retracting reel 105 and tether 110 are preserved. For example, following an inadvertent entanglement of the pen 115 with a purchased product (not shown) the O-ring 150 releases the anvil 130 prior to exertion of a force great enough to damage either the tether 110 or the retracting reel 105. Such release of the anvil 130 prior to exertion of a force great enough to damage either the tether 110 or retracting reel 105 is contemplated to reduce a likelihood of shopper injury and allow subsequent reinstallation of the released anvil 130.

Interaction between the anvil 130 and anvil retention assembly 135 may be apparent to the shopper, who may proceed to disentangle the pen 115 from which the anvil 130 has been released and to replace the anvil 130 into the pen 115 via orifice 145. In any event, installation of a replacement pen 115, whether it be the pen 115 from which the anvil 130 was released or a new pen 115, is easily accomplished with a need for neither disassembly of the point of sale device (not shown) nor a technician service repair call.

An insertion surface 210 of the anvil 130 is disposed at an angle 215 included between the insertion surface 210 and the axial centerline 195 of the anvil 130. It will be appreciated that application of force to the anvil 130 in the second direction 180 produces a reaction force 220 that is directed perpendicular to the insertion surface 210. The reaction force 220 thereby includes a first force component 222 aligned with the centerline 195 and a second force component 225 perpendicular to the centerline 195 applied from the insertion surface 210 to the O-ring 150. Further, it will be appreciated that the second force component 225 tends to deform or expand at least the inner diameter 170 of the O-Ring 150.

Accordingly, the O-ring 150 deforms in response to application of force via the anvil 130 in the second direction 180. As such, the O-ring 150 allows reinsertion of the anvil 130 via the orifice 145 in response to application of an amount of force that exceeds a reinsertion force. Properties of the material from which the O-ring 150 is fabricated as well as a thickness of the material influence an amount of deformation in response to a given amount of applied force. Further, selection of the angle 215 will influence a leverage of the applied force to deform the O-ring 150. The force applied in the second direction 180 is applied, via the insertion surface 210, over a length 230, and the force applied in the first direction 175, via the retention surface 185, is applied over a length 235. In an embodiment as depicted in FIGS. 2 and 3, angle 215 is less than angle 190, resulting in length 230 being greater than length 235. Accordingly, although the force to deform the O-ring 150 is the same, because the force applied in the second direction 180 via the insertion surface 210 to reinsert the anvil 130 is applied over the greater length 230, the amount of force required per unit length of insertion is less than an amount of force required per unit length of removal, thereby providing a leverage to increase an ease of insertion of the anvil 130 into the O-ring 150.

In one embodiment a grab extension 240 (shown extending outside of the collar 140 via orifice 145 in FIG. 2) of the anvil 130 provides a location on to which a user may hold the anvil 130 during reinsertion. The grab extension 240, in response to the external diameter 160 of the anvil 130 being retained by the O-ring 150, is disposed extending beyond the collar 140 via the orifice 145.

Figure 4:
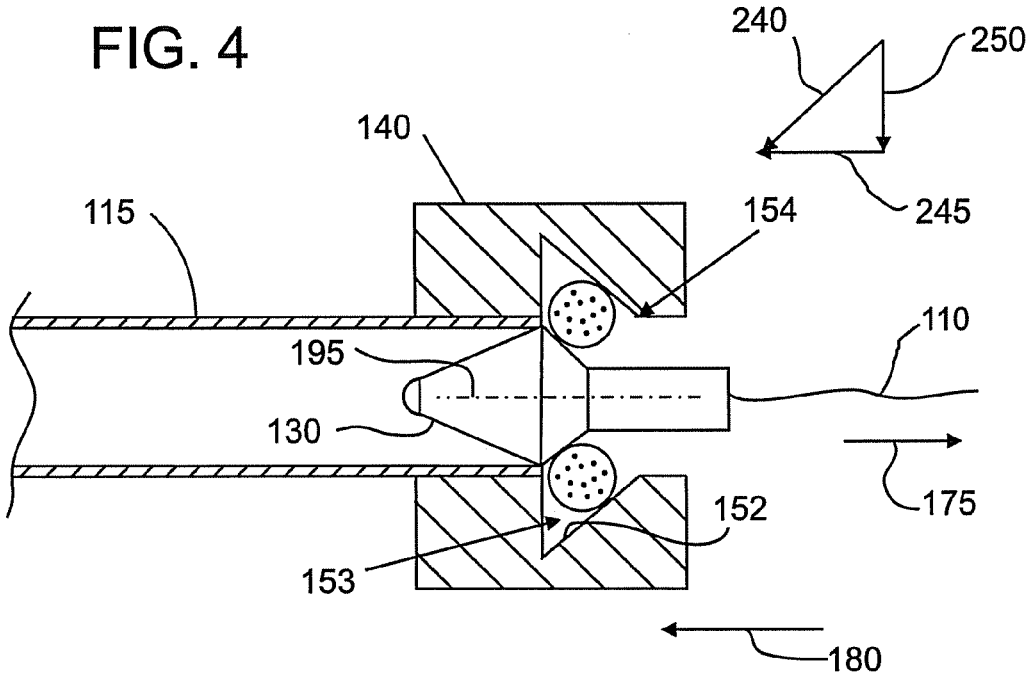
FIG. 4 is an enlarged cross section view of the pen retention device in accordance with another embodiment of the invention.

FIG. 4 depicts an alternate embodiment of the collar 140 described above, in which the surface 152 that defines the internal cavity 153 is disposed at an angle relative to the centerline 195 of the anvil 130 to provide a separation between the amount of force required to insert the anvil 130 and the amount of force required to extract the anvil 130. The surface 152 is disposed oriented sloping toward the centerline 195 in the first direction 175 (and sloping away from the centerline 195 in the second direction 180).

In addition to the reaction force 200 described above, application of force to the anvil 130 in the first direction 175 produces a reaction force 240 that is directed perpendicular to the interior surface 152. The reaction force 240 thereby includes a first force component 240 aligned with the centerline 195 and a second force component 250 perpendicular to the centerline 195, transferred from the interior surface 152 to the O-ring 150. The second force component 250 is directed opposite to the second force component 205 described above and tends to compress at least the outer diameter 165 of the O-Ring 150. It will be appreciated that compression of the outer diameter 165 of the O-Ring 150 shall provide compression of the inner diameter 170, thereby increasing an amount of force required to release the anvil 130.

As described above, application of force to the anvil 130 in the second direction 180 produces a reaction force 220 that is directed perpendicular to the insertion surface 210. The reaction force 220 thereby includes a first force component 222 aligned with the centerline 195 and a second force component 225 perpendicular to the centerline 195 applied from the insertion surface 210 to the O-ring 150. Further, it will be appreciated that the second force component 225 tends to deform or expand at least the inner diameter 170 of the O-Ring 150. As a result of the surface 152 being disposed sloping away from the centerline 195 in the second direction, surface 152 does not provide the second force component 250 that tends to compress the O-ring 150 in response to application of force to the anvil 130 in the second direction 180. Therefore, the amount of force required to insert the anvil 130 is less than the amount of force required to insert the anvil 130.

While an embodiment has been described having a rubber O-Ring as an elastic retainer 150, it will be appreciated that the scope of the invention is not so limited, and that embodiments are contemplated to include alternate elastic retainers 150, that may utilize alternate materials such as U-Clips, springs, and other members capable to elastically deform for release and insertion of the anvil 130.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A pen retention device for releasably securing a pen to a tether, the device comprising:

an end of the pen;

a collar comprising a first portion and a second portion, the first portion securedly attached to the pen proximate the end, the second portion defining an internal cavity surrounding the end and an orifice having a diameter;

an elastic retainer disposed within the internal cavity, an outer surface of the elastic retainer defining an internal dimension and an external dimension, the external dimension greater than the diameter of the orifice such that the internal cavity retains the elastic retainer; and an anvil securedly attached to the tether, the anvil comprising an angled retention surface having an external diameter, the external diameter of the angled retention surface greater than the internal dimension of the elastic retainer and less than the diameter of the orifice;

wherein the internal dimension of the elastic retainer retains the external diameter of the anvil disposed between the pen and the elastic retainer;

wherein the internal dimension of the elastic retainer is responsive to an application of force greater than a release force, via the angled retention surface, to deform and thereby release the anvil; and wherein the anvil comprises an axial centerline and a first angle included between the angled retention surface and the axial centerline, and wherein the anvil further comprises an angled insertion surface that includes a second angle between the angled insertion surface and the axial centerline, the first angle being greater than the second angle.

2. The pen retention device of claim 1, wherein the elastic retainer is a rubber O-ring.

3. The pen retention device of claim 1, wherein:

the anvil further comprises a grab extension; and in response to the external diameter of the anvil being retained by the elastic retainer, the grab extension extends beyond the collar via the orifice.

4. The pen retention device of claim 1, wherein:

the anvil is securedly attached to a first end of the tether; and the pen retention device further comprises a tether retracting reel in operable communication with a second end of the tether.

* * * * *